US010233557B2

(12) United States Patent
Higuchi et al.

(10) Patent No.: US 10,233,557 B2
(45) Date of Patent: Mar. 19, 2019

(54) ELECTROPLATING METHOD AND ELECTROPLATING DEVICE

(71) Applicants: Kabushiki Kaisha Toshiba, Minato-ku (JP); TOKYO INSTITUTE OF TECHNOLOGY, Meguro-ku (JP)

(72) Inventors: Kazuhito Higuchi, Yokohama (JP); Yusaku Asano, Yokohama (JP); Kyoko Honma, Kawasaki (JP); Kazuma Hiraguri, Yokohama (JP); Yasunari Ukita, Kamakura (JP); Masayuki Uchida, Yokohama (JP); Toshiya Nakayama, Kawasaki (JP); Mayumi Machino, Kawasaki (JP); Masato Sone, Yokohama (JP); Tso-Fu Mark Chang, Yokohama (JP)

(73) Assignees: KABUSHIKI KAISHA TOSHIBA, Minato-ku (JP); TOKYO INSTITUTE OF TECHNOLOGY, Meguro-ku (JP)

( * ) Notice: Subject to any disclaimer, the term of this patent is extended or adjusted under 35 U.S.C. 154(b) by 48 days.

(21) Appl. No.: 15/065,115

(22) Filed: Mar. 9, 2016

(65) Prior Publication Data

US 2016/0273121 A1 Sep. 22, 2016

(30) Foreign Application Priority Data

Mar. 18, 2015 (JP) ..... 2015-054850

(51) Int. Cl.
*C25D 7/12* (2006.01)
*C25D 3/38* (2006.01)
(Continued)

(52) U.S. Cl.
CPC ..... *C25D 7/123* (2013.01); *C25D 3/38* (2013.01); *C25D 5/003* (2013.01); *C25D 17/001* (2013.01); *C25D 5/34* (2013.01)

(58) Field of Classification Search
CPC ..... C25D 5/003
(Continued)

(56) References Cited

U.S. PATENT DOCUMENTS

2003/0019756 A1* 1/2003 Yoshida ..... B23H 3/08 205/88

FOREIGN PATENT DOCUMENTS

CN 1918326 A 2/2007
JP 2002-317300 A 10/2002
(Continued)

OTHER PUBLICATIONS

Office Action dated Dec. 12, 2016 in Korean Patent Application No. 10-2016-0025615 (with English language translation).
(Continued)

*Primary Examiner* — Bryan D. Ripa
(74) *Attorney, Agent, or Firm* — Oblon, McClelland, Maier & Neustadt, L.L.P.

(57) ABSTRACT

An electroplating method according to an embodiment is a electroplating method of generating a metal film on a cathode surface by setting a negative potential to a cathode of an anode and the cathode provided in a reaction bath, including mixing and accommodating a plating solution containing at least plated metal ions, an electrolyte, and a surface active agent and a supercritical fluid in the reaction bath and applying a current in a concentration of the supercritical fluid and a cathode current density in which a polarization resistance obtained from a cathode polarization curve while the plated metal ions are reduced is larger than before the supercritical fluid is mixed.

5 Claims, 5 Drawing Sheets

(51) Int. Cl.

| | |
|---|---|
| ***C25D 17/00*** | (2006.01) |
| ***C25D 5/00*** | (2006.01) |
| *C25D 5/34* | (2006.01) |

(58) Field of Classification Search
USPC ..... 205/88
See application file for complete search history.

(56) References Cited

FOREIGN PATENT DOCUMENTS

| | | | |
|---|---|---|---|
| JP | 2003-064485 | A | 3/2003 |
| JP | 3703132 | | 10/2005 |
| JP | 2006-152421 | A | 6/2006 |
| JP | 2006-233260 | A | 9/2006 |
| JP | 2007-063598 | A | 3/2007 |
| JP | 4101261 | | 6/2008 |
| JP | 4440609 | | 3/2010 |
| JP | 2012-233224 | A | 11/2012 |
| KR | 10-2005-0021630 | A | 3/2005 |
| TW | 201335442 | A1 | 9/2013 |

OTHER PUBLICATIONS

Hideo Yoshida et al. " Electroplating of Nanostructured Nickel in Emulsion of Supercritical Carbon Dioxide in Electrolyte Solution", Chemistry Letters, 2002, 2 pages.

Combined Taiwanese Office Action and Search Report dated Nov. 1, 2016 in Patent Application No. 105106346 (with English translation).

Li Quancai, et al., "Effect of Current Density on Surface Properties and Process Parameters of Nickel Film Electroformed under Supercritical $CO_2$ Fluids", Rare Metal Materials and Engineering, vol. 41 No. 7, Jul. 2012, pp. 1279-1283 (with English translation).

Hong, Kyo-Min, et al., "Characteristics of a Nickel Film Electroplated on a Copper Substrate in Supercritical $CO_2$", J. Ind. Eng. Chem., vol. 10, No. 4, (2004) 683-689.

* cited by examiner

ELECTROPLATING METHOD AND ELECTROPLATING DEVICE

CROSS-REFERENCE TO RELATED APPLICATION

This application is based upon and claims the benefit of priority from the prior Japanese Patent Application No. 2015-054850, filed Mar. 18, 2015, the entire contents of which are incorporated herein by reference.

FIELD

Embodiments described herein relate generally to an electroplating method and an electroplating device.

BACKGROUND

With development and widespread use of information processing technology in recent years, miniaturization, slimming-down, and higher performance of electronic devices are promoted and accordingly, semiconductor packages are also on a path to miniaturization. Particularly semiconductor packages of several pins to 100 pins frequently used for mobile terminals or the like change from conventional SOP (Small Out-line Package) or QFP (Quad Flat Package) to smaller non-lead type SON (Small Out-line Non-lead Package) or QFN (Quad Flat Non-lead Package) and more recently to still smaller WCSP (Wafer-level Chip Scale Package).

Common WCSP has a plurality of solder balls formed on the undersurface of the package in a grid pattern and is connected to the substrate electrode by these solder balls. WCSP is the smallest package that cannot be miniaturized any more because the internal semiconductor chip and the package have the same size.

The manufacturing process of packages such as SOP, QFP, SON, and QFN include a process of mounting semiconductor chips as individual pieces after dicing on a lead frame, a process of connecting semiconductor chips by wire bonding, a process of molding using a sealing resin, a process of cutting a lead, and a process of externally plating the lead. On the other hand, the manufacturing process of WCSP includes only a stage before producing semiconductor chips by dicing a wafer, that is, after solder balls are mounted on the surface of the semiconductor wafer, the wafer only needs to be diced into individual pieces and thus, WCSP is characterized by, compared with other packages, extremely high productivity.

In WCSP, the formation of a re-wire by the semi-additive method using electroplating of Cu is required to change the arrangement of electrode pads of a chip to the arrangement of solder balls. The semi-additive method includes five processes: the formation of a seed layer as a cathode for electroplating, the formation of a resist layer obtained by patterning a re-wire shape, Cu plating by electroplating, peeling of the resist layer, and etching of the seed layer. These processes are positioned between BEOL (Back-End Of Line) of a preceding process and a post process in terms of process and dimensions and so are called intermediate processes and equipment close to BEOL is used as mass-production equipment because a wafer process is used.

More specifically, for example, a laminated thin film of Ti and Cu is used to form a seed layer and a sputtering device that forms a metallic thin film on a wafer is used to form the laminated thin film. Also, a coater developer that automatically performs resist coating, baking, development, and cleaning/drying and a stepper exposure device are used to form a resist layer and a sheet-type plating device is used for electroplating. However, though throughput of these devices is high with several thousand wafers/month or more, each of these devices is extremely more expensive than a common post process device such as a wire bonding device and a die bonding device and also requires a larger installation space and so an initial investment amount is large, which makes application of these devices to diversified small-quantity production difficult and also a flexible response to changes of the quantity of production difficult.

Particularly, in an electroplating device that performs Cu plating, three processes of a pretreatment process to remove oxide from the surface of the seed layer, a Cu plating process, and a cleaning/drying process are needed and many devices have a separate treatment bath for each process to prevent mutual contamination between treatment and also an automatic transfer device between baths is needed so that the device tends to increase in size and also to become more expensive. Further in the Cu plating process, when a common copper sulfate plating solution is used, electroplating is normally performed in a current density of 5 $A/dm^2$ or less to maintain good film quality and thickness distribution and a deposition rate obtained in this case is about 1 μm/min at best even if the current efficiency is assumed to be 100% and if the thickness of 10 μm is needed, the time of about 10 min is needed.

Thus, to secure throughput of, for example, 10,000 wafer/month, it is necessary to prepare at least three Cu plating baths that take the longest treatment time, inviting an increasing size and higher costs.

Therefore, various technologies are under development to improve productivity. For example, a technology to perform a plating process safely, reasonably, and swiftly using supercritical or subcritical carbon dioxide is known (see, for example, Patent Documents 1 to 3).

A supercritical fluid is a fluid in a state belonging to none of the solid, liquid, and gas in a phase diagram determined by the temperature and pressure and its main features include high diffusibility, high densities, and zero surface tension so that when compared with conventional processes using a liquid, permeability at a nano level and a high-speed reaction can be expected. For example, the critical point where $CO_2$ enters a supercritical state is 31° C., 7.4 MPa and $CO_2$ is a supercritical fluid exceeding the above temperature or pressure. Supercritical $CO_2$ is not originally mixed with an electrolytic aqueous solution, but is made turbid by adding a surface active agent and applicable to electroplating, which is known as supercritical $CO_2$ emulsion (SCE) electroplating method.

A plating coat formed by the SCE electroplating method has features that leveling properties are high, pinholes are less like to arise, and crystal grains are made finer so that a close-grained film can be formed. A reaction field by the SCE electroplating method is considered to be a field in which micelles of supercritical $CO_2$ are dispersed to flow in an electrolytic solution and an overvoltage of the plating reaction is considered to rise due to desorption of micelles from the cathode surface so that crystal grains become finer. Supercritical $CO_2$ and hydrogen are known to be very miscible and hydrogen generated simultaneously with the deposition of metal is prevented from becoming an air bubble by being dissolved in $CO_2$ so that pinholes are inhibited from arising.

When WCSP is produced, as described above, a floor space to install large-scale production equipment and expensive initial investment are needed and applying WCSP to diversified small-quantity products that are not in line with the equipment and initial investment is practically difficult. Particularly in the Cu plating device, a plurality of treatment baths is needed due to circumstances of a series of processes of plating or to increase throughput, posing a problem of an increasing size or a rising cost of the device.

To reduce the number of plating baths in the plating device to a minimum, it is effective to increase the current density during plating to increase the deposition rate. For example, to describe by taking the above example, by increasing the current density from 5 $A/dm^2$ to 10 $A/dm^2$, the number of Cu plating baths needed for the throughput 10,000 wafer/month can be reduced from three baths to two baths. Further, if the current density can be increased to 20 $A/dm^2$, the number of Cu plating baths can be reduced to the minimum one bath. If the current density is further increased, an activation overvoltage when metal ions in the plating solution are reduced and a metal is deposited rises so that the crystal grain size becomes finer and the surface of a metal deposited film is advantageously smoothed.

On the other hand, a deposited film by plating is desirably formed uniformly on the surface of a plated substrate, but when the current density is increased, the thickness distribution of a deposited film is known to worsen. The thickness distribution of a plating deposited film is almost determined by a primary current distribution determined by an electric field distribution obtained from geometrical conditions such as the shape and arrangement of the cathode and the anode inside the plating bath and in the end determined by a secondary current distribution obtained by correcting the primary current distribution based on an electrochemical reaction on the surface of the cathode. The key factor to determine the secondary current distribution by correcting the primary current distribution is called a Wagner number (Wa) and represented by the following formula.

$$Wa=\kappa(\Delta\eta/\Delta i)$$

where κ is the specific electric conductance of the plating solution and $\Delta\eta/\Delta i$ is the polarization resistance of a polarization curve of the plating solution. When Wa=0, that is, the polarization is 0, the secondary current distribution is equal to the primary current distribution and with increasing Wa, compared with the primary current distribution, the secondary current distribution is improved to become uniform. The thickness distribution worsens with an increasing current density because $\Delta\eta/\Delta i$ in the above formula decreases with an increasing current density.

When the current density of the cathode is increased, the crystal grain size becomes finer and the surface of a metal deposited film is smoothed, but the polarization resistance decreases and the improvement effect of the secondary current distribution decreases so that convex abnormal growth such as a nodule is more likely to occur. The nodule is considered to grow using a particle or an impurity in the plating solution as a nucleus and once a convex shape is formed on the smooth plated film surface, the electric field distribution is changed and the current is concentrated onto the convex portion. When the polarization resistance is large and the improvement effect of the secondary current distribution is obtained, the current concentration is mitigated, but when the improvement effect is not obtained, the nodule further grows and also the current further concentrates and in the end, a large nodule is considered to be formed.

Further, to be noted when the current density of the cathode is increased is a hydrogen generation reaction on the surface of the cathode. For example, a sulfuric acid solution is used as the electrolyte in a common copper sulfate plating solution and when a potential at which hydrogen is generated is exceeded by increasing the current density, the reaction shown below occurs steeply and the plated film grows while hydrogen is generated intensely so that a porous plated film of undesirable quality having a low density is formed.

$$2H^+ + 2e^- \rightarrow H_2$$

The potential at which the reaction occurs is generally called a hydrogen overpotential and changes depending on pH of the electrolytic solution, the material of the cathode, and the surface state thereof. Particularly when the surface roughness is rough, the hydrogen overpotential decreases significantly. When the cathode current density is a high current density, as described above, the polarization resistance decreases and convex abnormal growth such as a nodule is more likely to arise and thus, there is the possibility of a decreased hydrogen overpotential and lower quality of a plated film in places such as corners of a plated object or a nodule where the current is more likely to concentrate. Therefore, when the current density is increased in the electroplating method, it is necessary to perform plating in a current density corresponding to a voltage sufficiently lower than the hydrogen overpotential and so increasing the deposition rate significantly is practically difficult.

The present invention is made in view of the above circumstances and an electroplating method by which even if the cathode current density is a high current density, the thickness distribution of a plated film is small and convex abnormal growth of a nodule or the like is inhibited and thus, degradation of film quality caused by hydrogen generation is not caused, wherein the deposition rate of plating can significantly be increased when compared with the rate of the conventional plating method and an electroplating device implementing the electroplating method are needed.

DETAILED DESCRIPTION

An electroplating method according to an embodiment is a electroplating method of generating a metal film on a cathode surface by setting a negative potential to a cathode of an anode and the cathode provided in a reaction bath, including mixing and accommodating a plating solution containing at least plated metal ions, an electrolyte, and a surface active agent and a supercritical fluid in the reaction bath and applying a current in a concentration of the supercritical fluid and a cathode current density in which a polarization resistance obtained from a cathode polarization curve while the plated metal ions are reduced is larger than before the supercritical fluid is mixed.

Figure 1:
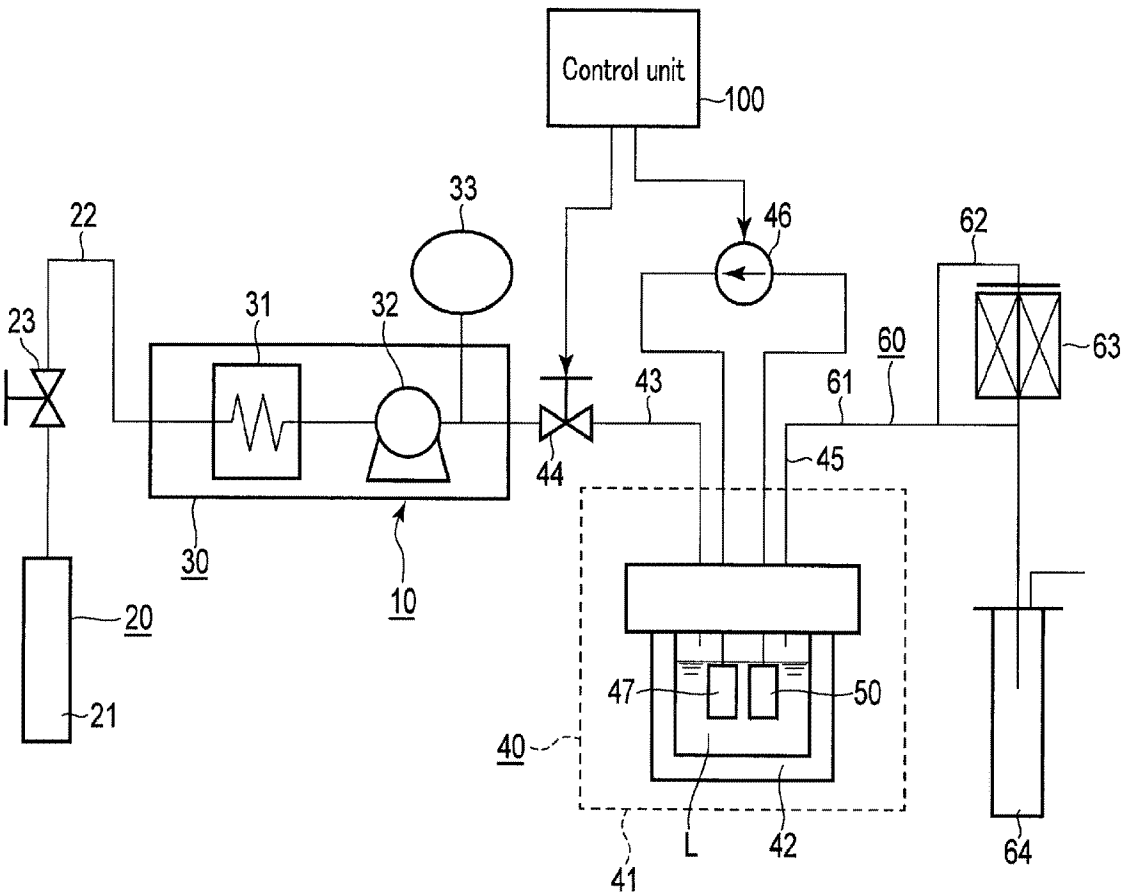
FIG. 1 is an explanatory view showing an outline configuration of an electroplating device used for an electroplating method according to a first embodiment.
Figure 2:
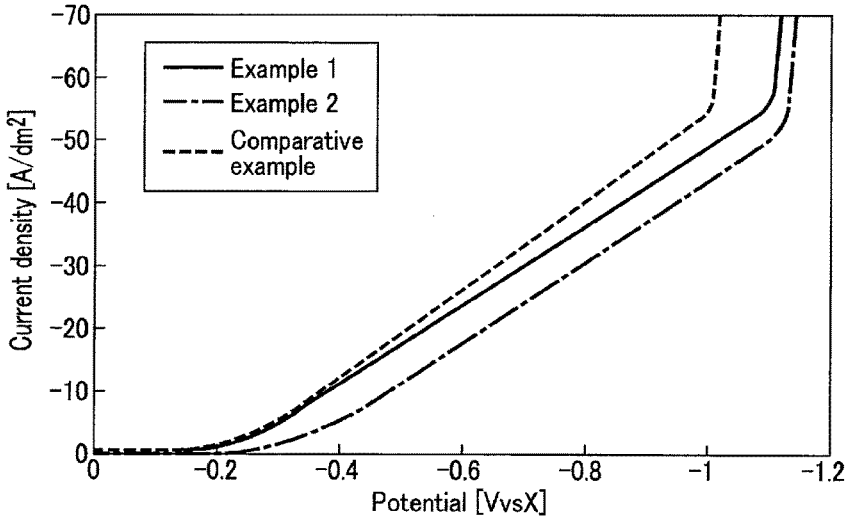
FIG. 2 is an explanatory view showing a cathode polarization curve of a cathode in the electroplating method.
Figure 3:
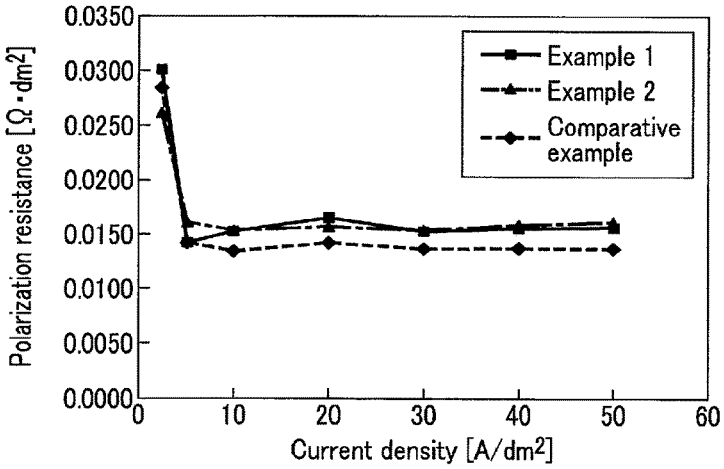
FIG. 3 is an explanatory view showing the relationship between a current density and a polarization resistance in the electroplating method.
Figure 4:
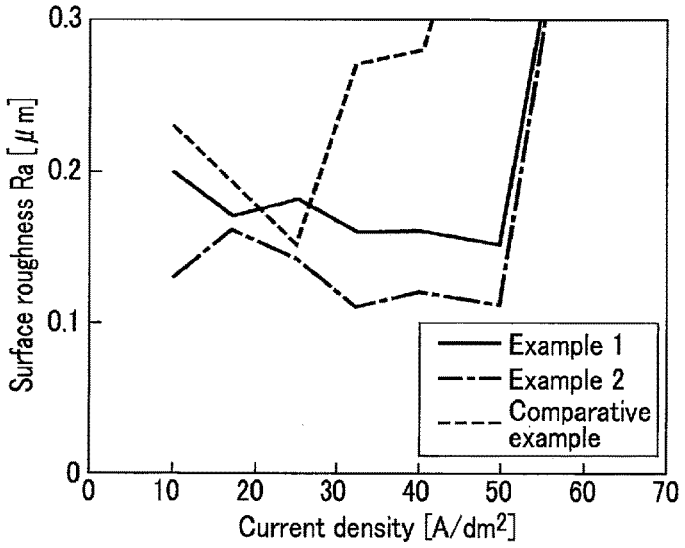
FIG. 4 is an explanatory view showing the relationship between the current density and surface roughness Ra of a plated film in the electroplating method.
Figure 5:
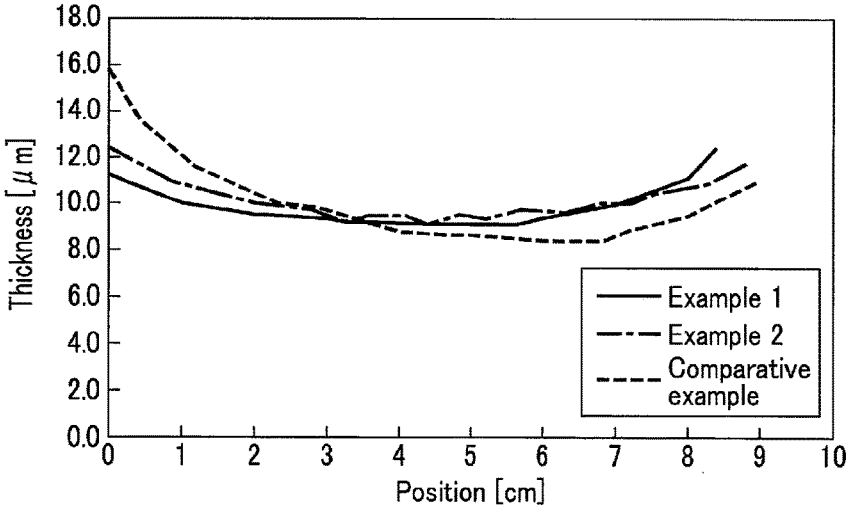
FIG. 5 is an explanatory view showing a thickness distribution of the plated film in the electroplating method.
Figure 6:
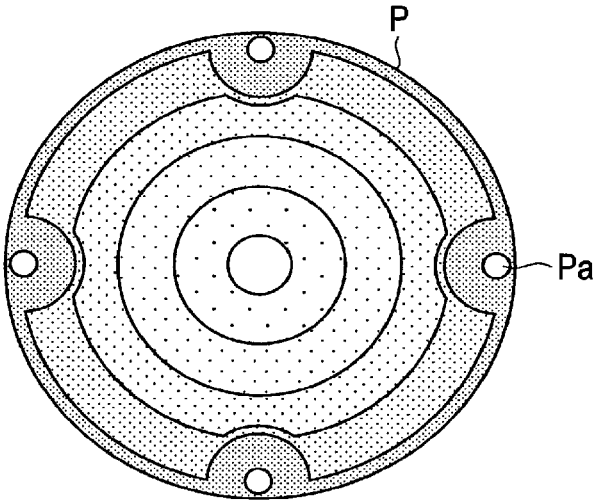
FIG. 6 is an explanatory view showing a potential distribution on a cathode surface in the electroplating method.

FIG. 1 is an explanatory view showing an outline configuration of an electroplating device 10 used for an electroplating method according to the first embodiment, FIG. 2 is an explanatory view showing a cathode polarization curve of a cathode in the electroplating method, FIG. 3 is an explanatory view showing the relationship between a current density and a polarization resistance in the electroplating method, FIG. 4 is an explanatory view showing the relationship between the current density and surface roughness Ra of a plated film in the electroplating method, FIG. 5 is an explanatory view showing a thickness distribution of the plated film in the electroplating method, and FIG. 6 is an explanatory view showing a potential distribution on a cathode surface in the electroplating method.

In the present embodiment, $CO_2$ is used as the supercritical fluid and a case when a Cu film is formed as a plated film is taken as an example.

In the present embodiment, when a Cu coat is formed by electroplating using a plating solution in which a supercritical fluid is made turbid, the thickness distribution of a plated film decreases and the surface roughness of a coat decreases in the neighborhood of a high current density and a high potential area where the polarization resistance obtained from a cathode polarization curve increases and particularly a plating reaction is accompanied by the generation of hydrogen and also convex abnormal growth such as a nodule is inhibited and thus, even of the cathode potential is a potential near the electrode of the hydrogen generation potential, electroplating not accompanied by degradation of film quality due to partial hydrogen generation like the conventional plating method can be performed.

The electroplating device 10 includes a carbon dioxide supply unit 20, a temperature control pump 30, a plating treatment unit 40, a discharge unit 60, and a control unit 100 that links and controls these units.

The carbon dioxide supply unit 20 includes a carbon dioxide cylinder 21 in which high-pressure carbon dioxide is stored, a supply pipe 22 whose one end is connected to the carbon dioxide cylinder 21 and whose other end is connected to the temperature control pump 30, and a supply valve 23 that controls the flow rate of the supply pipe 22.

The temperature control pump 30 includes a heater 31 that heats a carbon dioxide gas supplied from the supply pipe 22, a compressor 32 that compresses a carbon dioxide gas, and a manometer 33 connected to an exit side of the compressor 32.

The heater heats carbon dioxide to the critical temperature 31.1° C. thereof or higher. The compressor 32 pressurizes a carbon dioxide gas to a predetermined pressure, for example, the critical pressure 7.38 MPa thereof or higher.

The plating treatment unit 40 includes a temperature controlled bath 41, a reaction bath 42 in which a plating solution L is accommodated, arranged inside the temperature controlled bath 41 and a supply pipe 43 whose one end is connected to the exit of the compressor 32 and whose other end is connected to inside the reaction bath 42, a control valve 44 that controls the flow rate of the supply pipe 43, an exit pipe 45 whose one end is connected to inside the reaction bath 42 and whose other end is connected to the discharge unit 60, a DC constant current source 46 for energization, an anode 47 connected to the positive electrode side of the DC constant current source 46 and provided inside the reaction bath 42, and a cathode portion 50 connected to the negative electrode side of the DC constant current source 46 and provided inside the reaction bath 42 to support a substrate P forming a Cu coat.

A stainless pressure vessel whose inner wall is coated with Teflon (registered trademark) is used as the reaction bath 42. The reaction bath 42 introduces $CO_2$ in a supercritical state with a plating solution. A common copper sulfate plating solution prepared by adding a surface active agent to a solution in which copper sulfate 5 hydrate and sulfuric acid are mixed is used as the plating solution. Here, a copper pyrophosphate plating solution or a copper sulfamate plating solution may also be used as the plating solution and the plating solution is not to be limited to some specific one.

A pure Cu plate is used as the anode 47 and a lead connected to the positive electrode of the power source is connected for energization. As the material of the anode, a Cu plate containing P is desirably used. Further, an insoluble noble metal may be used as the anode.

As the substrate P supported by the cathode portion 50, a Ti/Ni/Pd laminated film formed on an Si wafer as a seed layer by a physical deposition method such as sputtering or the evaporation method is used. Here, the Ti layer is formed for the purpose of increasing adhesion strength to the Si wafer. Thus, the thickness thereof is set to about 0.1 μm. On the other hand, Ni mainly contributes to feeding and thus, the thickness thereof is desirably 0.2 μm or more. Pd is a film to prevent oxidation of the Ni surface and the thickness thereof is set to about 0.1 μm. When plating is performed like a pattern, a resist pattern having an opening only in a portion to be plated may be formed on a seed layer.

Subsequently, a lead connected to the negative electrode of a power source for energization is connected to an end of the Si wafer in which the seed layer is formed and the Si wafer is masked.

The discharge unit 60 includes a discharge pipe 61 whose one end is connected to the exit pipe 45 and whose other end is connected to a treatment vessel 64 described below, a branch pipe 62 branched from the discharge pipe 61, a back pressure regulating valve 63 provided in the branch pipe 62, and the treatment vessel 64.

The electroplating device 10 configured as described above performs electroplating as described below. The substrate P is soaked in an $H_2SO_4$ aqueous solution of 10 wt. % for 1 min. as a plating pretreatment. The purpose of the pretreatment is to remove natural oxide formed on the Pd surface on the seed layer surface. The type and composition of a pretreatment solution capable of reliably removing the oxide and the treatment time are desirably changed appropriately depending on the growth state of the oxide.

After the substrate P and the anode are installed inside the reaction bath 42, a plating solution L is poured into the reaction bath 42 and the cover of the reaction bath 42 is closed for sealing. A liquefied $CO_2$ cylinder of 4N is used for $CO_2$ and the temperature thereof is controlled to 40° C. and then the pressure inside the reaction bath 42 is adjusted to 15 MPa by a high-pressure pump and back pressure control. The reaction bath 42 is also put into the temperature controlled bath 41 and the temperature thereof is controlled to 40° C. The volume ratio of the plating solution and $CO_2$ is adjusted to 8:2, that is, $CO_2$ is adjusted to be 20 vol. %. The critical point where $CO_2$ enters a supercritical state is 31° C., 7.4 MPa, but in the present embodiment, margins of the critical temperature+9° C. and the critical pressure+7.6 MPa are set so that the entire $CO_2$ inside the reaction bath 42 reliably enters the supercritical state. These values can appropriately be determined by considering the temperature and pressure distributions inside the reaction bath 42.

After making sure that the pressure and temperature inside the reaction bath 42 have reached predetermined values and stabilized, the DC constant current source 46 is turned on to pass a constant plating current for a predetermined time. Then, after the constant plating current is passed for the predetermined time, the pressure inside the reaction bath is restored to the normal pressure and the substrate on which a Cu coat is formed is taken out and then washed in water and dried.

Here, the method of determining the current density of the plating current described above will be described. That is, in order to inhibit the thickness distribution of a plated film and convex abnormal growth such as a nodule and also to avoid degradation of film quality accompanying hydrogen generation, the cathode current density is adjusted to 42 A/dm$^2$ for the plating current such that from FIG. 2, the concentration of supercritical $CO_2$ is 20 vol. % and the potential of the cathode is 80% of the hydrogen overvoltage 1.1 V, that is, 0.88 V.

The polarization resistance obtained from the cathode polarization curve in this case is 1.1 times the polarization resistance when $CO_2$ is not introduced or more from FIG. 3 and thus, the thickness distribution of a plated film and convex abnormal growth such as a nodule can be inhibited. In the present embodiment, the concentration of supercritical $CO_2$ is set to 20 vol. % and the cathode current density is set to 42 A/dm$^2$, but if the cathode current density is a current density in which the polarization resistance is 1.1 times the polarization resistance when $CO_2$ is not introduced or more and less than a current density in which the potential is 80% of the hydrogen overvoltage, a similar effect can be gained.

Deposited Cu deposition amount measurements by ICP-AES, surface form observations by a microscope and a laser microscope, and thickness distribution measurements by a probe type step profiler of the substrate P on which a Cu coat is formed are performed. The current efficiency of a plating reaction is determined as a ratio (%) of the measured deposited Cu deposition amount to the theoretical deposition amount. For thickness distribution measurements, the formed Cu coat is first processed into a line of the width 200 μm by the subtractive method. The line is formed with 500 μm pitches in the transverse direction of the sample the thickness thereof is measured by the probe type step profiler in parallel with the transverse direction.

The deposited Cu deposition amount measured by ICP-AES is 8.90 mg with respect to the theoretical deposition amount 9.13 mg determined from the Faraday's law, which yields 97% as the current efficiency. From the above result, it is clear that almost all of the given amount of charge contributes to deposition of plating and hydrogen is barely generated. Also, as a result of appearance observations of the film surface, no nodule growth is confirmed and the surface roughness Ra measured by the laser microscope is 0.16 μm. As a result of thickness distribution measurements, the Cu thickness distribution is ±18%, which is quite similar to the thickness distribution shown in FIG. 5.

Next, a case when a plating solution in which supercritical $CO_2$ is made turbid is used by the electroplating method according to the present embodiment (Examples 1, 2) and a case when a common copper sulfate plating solution containing no supercritical fluid (Comparative Example) will be described by comparing both cases.

FIG. 2 shows a cathode polarization curve. Values shown on the vertical axis and the horizontal axis in FIG. 2 are negative values because the current density and the potential of a cathode are shown respectively and hereinafter, when the size relation of the current density and the potential of the cathode is described, the relation will be described using absolute values thereof.

The solution temperature and the concentration of the electrolyte/ions contained in the electrolytic solution in both cases of using a common copper sulfate plating solution containing no supercritical fluid and making supercritical $CO_2$ turbid and only the concentration of supercritical $CO_2$ is different in both cases. The concentration of supercritical $CO_2$ is shown for Example 1 (20 vol. %) and Example 2 (30 vol. %). As is evident from FIG. 3, for example, while the polarization resistance in the current density of 30 A/dm$^2$ is about 14 mΩ·dm$^2$ in Comparative Example, the polarization resistance in the $CO_2$ concentration 20 vol. % is about 15 mΩ~dm$^2$ and the polarization resistance in the $CO_2$ concentration 30 vol. % is about 16 mΩ·dm$^2$, which shows that the polarization resistance increases with an increasing $CO_2$ concentration.

In Comparative Example, the polarization resistance $\Delta\eta/\Delta i$ in the current density of 2 A/dm$^2$ is about 28 mΩ/dm$^2$ and large, but the polarization resistance $\Delta\eta/\Delta i$ in the high current density area of 10 A/dm$^2$ or more is 13 to 15 mΩ/dm$^2$, which is smaller than the polarization resistance in a low current density.

It is clear that the current increases rapidly in a high potential area of the cathode polarization curve in FIG. 2 and this shows that a reaction of hydrogen generation occurs and from the potential thereof, the hydrogen overvoltage is about 1.0 V in Comparative Example and about 1.1 V in Examples 1, 2. If, as an example, the target thickness distribution of a plated film is defined as less than ±20%, the concentration of supercritical $CO_2$ may be set to 20 or 30 vol. % and the potential of the cathode to 80% of 1.1 V, that is, 0.88 V to maximize the plating deposition rate. In this way, even a portion of the highest potential in the wafer plane does not reach the hydrogen generation potential. The cathode current density at this point is 42 A/dm$^2$ in Example 1 and 36 A/dm$^2$ in Example 2.

Next, FIG. 3 shows the relationship between the cathode current density and the polarization resistance when the concentration of supercritical $CO_2$ is used as a parameter. The polarization resistance may be higher in Comparative Example than in Examples 1, 2 in a low current density area of the cathode current density, but in a high current density area, the polarization resistance in Example 2 is higher and the value thereof is 1.1 times the value in Comparative Example or more. That is, an increasing effect of the polarization resistance when supercritical $CO_2$ is mixed is not obtained in a low current density area and obtained first in a high current density area. From FIG. 3, the current density area of 10 A/dm$^2$ or more is an area where the polarization resistance in Example 1 is larger than in Comparative Example and the current density area of 5 A/dm$^2$ or more is an area where the polarization resistance in Example 2 is larger than in Comparative Example.

FIG. 4 show the relationship between the cathode current density and the surface roughness Ra when the $CO_2$ concentration is used as a parameter. In Comparative Example, the surface roughness Ra decreases with an increasing current density up to the current density of 25 A/dm$^2$, but when the current density exceeds 30 A/dm$^2$, Ra significantly increases due to the generation of nodule.

In Examples 1, 2, on the other hand, Ra tends to almost monotonously decrease with an increasing current density up to 50 A/dm$^2$. Hydrogen is generated on the cathode surface at 50 A/dm$^2$ in Comparative Example and at 60 A/dm$^2$ in Examples 1, 2, which extremely degrades Ra. Thus, when supercritical $CO_2$ is introduced, even if the current density is increased immediately before hydrogen is generated, no nodule is generated and a high-quality plated film is obtained. This is because, as shown in FIG. 3, a high polarization resistance is maintained also in a high current density/high potential area.

FIG. 5 shows the thickness distribution of the plated film in Comparative Example and Examples 1, 2. The cathode current density is 32 A/dm$^2$ in all cases. In all cases, the distribution has a thick film near positions 0 cm and 9 cm as both ends of a plated object and a thin film near positions 4 to 5 cm in the center. It is clear, however, that the size of the distribution is smaller in Examples 1, 2 than in Comparative Example. Measurements of the distribution show that the size thereof is ±36.8 μm in Comparative Example, but the size thereof is ±16.8 μm in Example 1 and ±16.9 μm in Example 2, which are significant improvements. The result is considered, like the result of the surface roughness described above, to be caused by the fact that a high polarization resistance is maintained even in a high current density/high potential area by introducing supercritical $CO_2$.

FIG. 6 is an explanatory view schematically showing the potential distribution generated in the wafer plane as the substrate P. A conductive seed layer formed on a wafer surface to be a cathode has an electric resistance component. When such a wafer is plated, a feeding point connected to the negative electrode of a plating power source is provided on an end of the wafer to effectively use the wafer area. Because the seed layer has a resistance component, the potential distribution in the wafer plane during plating can be made uniform by equally providing as many feeding points as possible in the wafer periphery.

FIG. 6 shows the potential distribution when a feeding point Pa is equally provided in four places in the wafer periphery. The potential distribution can be made more uniform by increasing the feeding points, but the potential in the wafer center where the feeding points cannot be increased always decreases when compared with the wafer periphery. In FIG. 6, a dark portion shows a portion where the potential is high and a light portion shows a portion where the potential is low.

When a potential distribution arises in the wafer plane, a distribution of the plating current arises in accordance with the potential distribution, leading to a thickness distribution. The plating current distribution is determined by, in addition to the potential distribution in the wafer plane, the secondary current distribution described above. Even if the secondary current distribution should be completely uniform, it is necessary to limit at least the in-plane distribution of the potential of the seed layer to less than ±X % to limit the wafer in-plane distribution of the plated film thickness to less than ±X %.

According to the electroplating method by an electroplating device according to the present embodiment, the plating current distribution is always less than ±X % from characteristics of the cathode polarization curve shown in FIG. 2. Thus, to maximize the plating deposition rate by setting the target thickness distribution of the plating film to less than ±X %, electroplating may be performed by applying the voltage of (100−X) % of the voltage at which hydrogen is generated on the cathode surface while plated metal ions are reduced to the cathode.

From the above result, by mixing supercritical $CO_2$ into a plating solution and setting the cathode current density to a current density in which the polarization resistance is 1.1 times (110%) the polarization resistance when supercritical $CO_2$ is not introduced, even if the cathode current density in electroplating is a high current density, the thickness distribution of a plated film is small and convex abnormal growth of a nodule or the like is inhibited and thus, electroplating not accompanied by degradation of film quality caused by hydrogen generation can be performed and the deposition rate of plating can significantly be made faster than the rate of the conventional method.

If the maximum thickness distribution on the cathode surface is set to X % (for example, 80%), the thickness distribution can be controlled by setting the cathode potential while plated metal ions are reduced to a potential lower than X % of the potential at which hydrogen is generated as an absolute value.

According to the electroplating method by an electroplating device according to the present embodiment, even if the cathode current density in electroplating is a high current density, the thickness distribution of a plated film is small and convex abnormal growth of a nodule or the like is inhibited and thus, electroplating not accompanied by degradation of film quality caused by hydrogen generation can be performed and the deposition rate of plating can significantly be made faster.

As a result, the plating treatment time is reduced and the number of baths of the plating device can be reduced so that an increasing size and a rising price of the plating device accompanying the expansion of throughput, which has posed a problem, can significantly be limited.

Because carbon dioxide having a critical point of a relatively low temperature and low pressure is used as the supercritical substance, a supercritical state can be obtained easily and swiftly using relatively small energy and the cost of using the substance can be reduced and also the compressive strength of the reaction bath 42 can be relaxed and the production cost thereof can be reduced.

Figure 7:
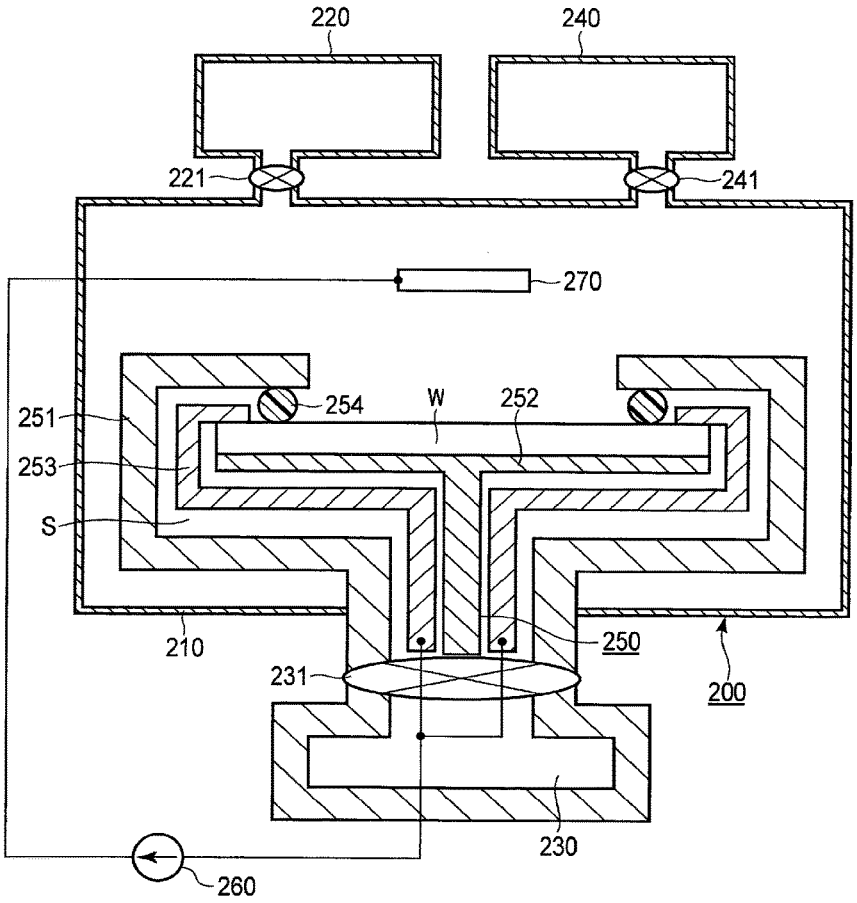
FIG. 7 is an explanatory view showing the outline configuration of an electroplating device used for the electroplating method according to a second embodiment.

FIG. 7 is an explanatory view showing the outline configuration of an electroplating device 200 used for the electroplating method according to the second embodiment.

The electroplating device 200 includes a plating bath 210 to treat work by being filled with a plating solution in which a supercritical fluid, for example, supercritical $CO_2$ is mixed.

A $CO_2$ storage tank for plating solution (supercritical fluid supply unit for plating solution) 220 to supply $CO_2$, a $CO_2$ storage tank (gas supply unit) 230 to supply $CO_2$ to a space S, and a plating solution tank 240 to supply a plating solution to the plating bath 210 are connected to the plating bath 210 via valves 221, 231, 241 respectively. Here, $CO_2$ stored in the storage tank 230 may be a gas or a supercritical fluid. A work fixing jig 250 to hold disc-like work W such as the wafer Si to be plated is arranged inside the plating bath 210.

The work fixing jig 250 includes a cabinet 251 in a cylindrical shape whose top surface is open. A collar portion 251*a* is provided from an opening edge of the cabinet 251 toward the center side and arranged along an outer edge of the surface of the work W.

An adsorption jig (support portion) 252 that fixes the work W by adsorption from below the undersurface, an electrode (lead) 253 as a negative electrode to pass a current to the work W via an electrode pad during plating, and a sealer 254 such as an O ring to prevent intrusion of the plating solution into a space between the adsorption jig 252 and the cabinet 251 are included inside the cabinet 251. The adsorption jig 252 is further supported by a support column 255 in a columnar shape and the support column 255 extends coaxially with the cabinet 251.

The cabinet 251 is formed like surrounding a peripheral portion of the surface of the work W supported by the adsorption jig 252 described below and the side face and the rear face of the work W and has a function to protect the work W from the plating solution. At least a contact point of the electrode and the work W of the area covering the surface of the work W needs to be hidden.

Incidentally, S in FIG. 7 shows a space surrounded by the cabinet 251, the sealer 254, and the work W and is connected to the $CO_2$ storage tank 230.

A DC constant current source (plating power source) 260 is arranged between an anode 270 and the electrode 253 as a negative electrode and a negative potential is supplied to the electrode 253.

The electroplating device 200 configured as described above performs electroplating as described below. The work W having been pretreated (such as acid cleaning) is fixed by the adsorption jig 252 by adsorption. The electrode 253 is connected to an end of the work W. The gap between the work W and the cabinet 251 is closed by the sealer 254 by, for example, moving the adsorption jig 252 to press against the cabinet 251. The anode 270 is installed inside the plating bath 210. The space S is filled with $CO_2$.

The plating bath 210 is filled with a plating solution (at this point, the pressure of $CO_2$ in the space S is raised so that the plating solution does not enter the space S).

The ratio of the plating solution and $CO_2$, the temperature, and the pressure inside plating bath 210 are adjusted to target values by adding $CO_2$ to the plating bath 210 and the space S simultaneously while the pressure inside the plating bath 210 is maintained lower than the pressure in the space S. After the state is stabilized, the DC constant current source 260 is turned on to pass a current for a predetermined time. The plating power source is turned on.

The pressure inside the plating bath 210 is lowered close to the normal pressure while the pressure is maintained lower than the pressure in the space S. The plating solution is drained out of the plating bath 210. The work w is taken out and then washed in water and dried.

According to the electroplating device as described above, an electrode portion can be protected from the plating solution by preventing the plating solution from intruding into the space S from the plating bath 210 by adjusting the pressure of $CO_2$ sent from the $CO_2$ storage tank for plating solution 220 and the $CO_2$ storage tank 230 to maintain a state of "pressure inside the plating bath 210"<"pressure in the space S" while the plating bath 210 is filled with the plating solution, a current is passed, and the plating solution is drained.

The reason for adopting the above configuration is as described below. That is, in the plating process of a semiconductor wafer, an anode plate and work (cathode plate) are normally installed inside the plating solution, an electrode (lead connected to the negative electrode of the power source) is connected to the anode plate and the work, and a current is passed to plate the work surface. If, in this case, a connection portion of the work and the electrode is exposed, the current also flows to the portion and plating is deposited there. The supply of ions to the wafer surface to be originally plated decreases, causing shifts in plating thickness. Countermeasures such as masking the electrode, the work, and a connection portion of the electrode with a tape material or pressing a jig against a connection portion for sealing and protection are taken.

In the electroplating device using a supercritical fluid, however, the plating bath is filled with a plating solution in which supercritical $CO_2$ is dissolved and the pressure of the solution is large and also supercritical $CO_2$ has features such as large fluidity and a small surface tension and a liquid may infiltrate into masking. Thus, in plating treatment by the electroplating device 200 using a supercritical fluid, it is necessary to inhibit the plating solution from infiltrating into an electrode connection portion of the work W.

The sealer 254, for example, an O ring made of rubber may intentionally be slit to allow supercritical $CO_2$ to be slightly leaked from the space S into the plating bath 210. This is because plating properties are not affected even if the $CO_2$ concentration in the plating solution slightly rises.

Because carbon dioxide having a critical point of a relatively low temperature and low pressure is used as the supercritical substance, a supercritical state can be obtained easily and swiftly using relatively small energy and the cost of using the substance can be reduced and also the compressive strength of the plating bath 210 can be relaxed and the production cost thereof can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electroplating method of generating a metal film made of a metal on a cathode surface, wherein the cathode surface includes a seed layer comprising an outer layer of palladium, by setting a negative potential to a cathode of an anode and the cathode provided in a reaction bath, the method comprising:

mixing and accommodating a plating solution containing at least metal ions of the metal, an electrolyte, and a surface active agent and a supercritical fluid in the reaction bath; and applying a current in a concentration of the supercritical fluid and a cathode current density in which a polarization resistance obtained from a cathode polarization curve while the metal ions are reduced in the reaction bath is larger than before the supercritical fluid is mixed with the plating solution.

2. The electroplating method according to claim 1, wherein the concentration of the supercritical fluid and the cathode current density are such that the polarization resistance is at least 110% of the polarization resistance before the supercritical fluid is mixed or more.

3. The electroplating method according to claim 1, wherein the supercritical fluid is a supercritical $CO_2$ fluid.

4. The electroplating method according to claim 1, wherein when a maximum thickness distribution on the cathode surface is X %, a cathode potential while the plated metal ions are reduced is set to a potential lower than X % of the potential at which hydrogen is generated as an absolute value.

5. The electroplating method according to claim 1, wherein the plating solution contains at least copper sulfate, sulfuric acid, and the surface active agent.

* * * * *